US005156465A

United States Patent [19]

Kakiuchi

[11] Patent Number: 5,156,465

[45] Date of Patent: Oct. 20, 1992

[54] PRINTER FOR PRINTING INFORMATION ON CENTER-FOLDING TYPE BOOK IN OPEN STATE

[75] Inventor: Yoshihiro Kakiuchi, Hino, Japan

[73] Assignee: Fujitsu Limited, Kawasaki, Japan

[21] Appl. No.: 697,382

[22] Filed: May 9, 1991

[30] Foreign Application Priority Data

May 10, 1990 [JP] Japan ..... 2-120699

[51] Int. Cl.[5] ..... B41J 11/20

[52] U.S. Cl. ..... 400/56; 400/24

[58] Field of Search ..... 400/55, 56, 57, 58, 400/605, 24; 235/379

[56] References Cited

U.S. PATENT DOCUMENTS

| | | | |
|---|---|---|---|
| 3,868,008 | 2/1975 | Brumbaugh | 400/56 |
| 3,912,068 | 10/1975 | Kwan et al. | 400/56 |
| 3,951,251 | 4/1976 | Zaccagning, Jr. | 400/56 |
| 3,978,964 | 9/1976 | Kwan | 400/58 |
| 4,184,780 | 1/1980 | Kurahara | 400/58 |
| 4,780,007 | 10/1988 | Weeks et al. | 400/56 |
| 4,893,949 | 1/1990 | Limberger et al. | 400/56 |
| 4,927,277 | 5/1990 | Mikawa | 400/56 |
| 5,040,908 | 8/1991 | Matsuya et al. | 400/56 |

FOREIGN PATENT DOCUMENTS 0063282 4/1982 Japan .

*Primary Examiner*—Eugene H. Eickholt

*Attorney, Agent, or Firm*—Armstrong & Kubovcik

[57] ABSTRACT

A printer is used for printing information on a center-folding type book when the book is in the open state, and comprises a printing head, a platen movable toward and away from the printing head, and feed rollers for moving the opened book through the printing position defined by the printing head and the platen, such that the printing operation is carried out on a leading half of the book and then on a trailing half thereof. A gap between the printing head and the platen is adjusted in response to a variation of a thickness of the half of the book positioned at the printing position; this adjustment being carried out by abutting the platen against the half of the book, and then moving the platen away therefrom by a given distance, before the printing operation is carried out on a first line contained in the trailing half of the book and closest to a center-holding line thereof. The book is then further moved so that the first line is moved away from the printing position, to carry out a proper adjustment of the gap with respect to the trailing half of the opened book.

6 Claims, 10 Drawing Sheets

| |
|---|
| Fig. 2A |
| Fig. 2B |
| Fig. 2C |
| Fig. 2D |
| Fig. 2E |
| Fig. 2F |

PRINTER FOR PRINTING INFORMATION ON CENTER-FOLDING TYPE BOOK IN OPEN STATE

BACKGROUND OF THE INVENTION

1) Field of the Invention

The present invention relates to a printer for printing information in a center-folding type book when the book is in the open state.

2) Description of the Related Art

Usually, this type of printer is incorporated into an automatic teller machine (ATM), a cash dispenser (CD) or the like installed in financial facilities, whereby transactions made therein are registered or printed out on the center-folding type book, such as a bankbook, passbook or the like, by the printer. These machine have an entrance port for inserting the book in the open state, and the inserted book is then guided to a printing position defined by a platen and a printing head of the printer. Information on the transaction, etc. is then printed out on the open pages of the book in parallel with the center-holding line thereof, while the book is moved step by step through the printing position, i.e., the gap between the platen and the printing head. In this case, one half side of the opened book may have a different thickness to that of the other half side thereof except where the book is opened at the center thereof so that both half sides thereof have the same thickness, and thus the gap between the platen and the printing head must be adjustable, to enable the printing to be always carried out at a constant optimum printing pressure on the half sides of the opened book each having a different thickness.

It has been proposed that the gap between the platen and the printing head be adjusted in response to a thickness of the half side of the opened book on which the information is to be printed, and therefore, in this printer, the platen is movable with respect to the printing head, and an adjustment of the gap therebetween is made by a movement of the platen whenever one half side of the opened book is newly positioned at the printing position. In particular, the platen is first moved toward the printing head until it is abutted against the half side of the opened book positioned therebetween, and is then moved back and away from the half side of the book by a given distance, so that a constant gap can be obtained between the printing head and the half side of the book regardless of a variation in the thickness thereof, whereby a constant optimum printing pressure can be ensured.

In the printer as mentioned above, the movement of the platen toward the printing head must be stopped when the platen abuts against the half side of the opened book, and accordingly, a movable rod-like element, which is associated with a suitable sensor, such a photosensor attached to the platen, is used. In particular, the movable rod-like element is first abutted against the half side of the book before the platen toward the printing head is stopped when a part of the rod-like element (for example, a lower end therof) is detected by the sensor attached to the platen, whereby an abutting of the platen against the half side of the book can be obtained.

Nevertheless, this detection system cannot function properly when the printing operation carries over from one half side of the opened book to the other half side thereof. In particular, when the printing is carried out on the other or trailing half side of the book, with regard to the direction in which the book is moved during the printing operation, after the printing of the leading half side thereof, the gap adjusted with respect to the leading half side of the book must be re-adjusted with respect to the trailing half side thereof. This re-adjustment, however, cannot be properly carried out by the detection system as mentioned above, because the rod-like element is abutted against the trailing half side of the book at a location close to the center-holding line thereof. Namely, a portion of the trailing half side of the book which is close to the center-holding line thereof does not represent a proper thickness of the trailing half side of the book, because the portion concerned is curved due to the binding of the leaves of the book.

SUMMARY OF THE INVENTION

Therefore, an object of the present invention is to provide a printer of the type as mentioned above, in which a proper adjustment of the gap between the platen and the printing head can be ensured even if the printing operation is carried over from one half side of the opened book to the other half side thereof.

In accordance with the present invention, there is provided a printer for printing information on a center-folding type book when the book is in the open state, which comprises: a printing head; a platen movable toward and away from the printing head; feeder means for moving the opened book through a printing position defined by the printing head and the platen, in such a manner that the printing operation is carried out on a leading half side of the opened book and then carried out on a trailing half side thereof; and adjustment means for adjusting a gap between the printing head and the platen in response to a variation of a thickness of the half side of the opened book positioned at the printing position. The adjustment means includes detection means for detecting an abutting of the platen against the half side of the opened book during a movement of the platen toward the printing head, and means for moving the platen away from the printing head by a given distance after the abutting of the platen against the half side of the opened book, whereby it is possible to obtain a constant optimum gap between the printing head and the platen regardless of a variation of the thickness of the half side of the opened book. According to the present invention, before the printing is carried out on a first line of the trailing half of the opened book and closest to a center-holding line thereof, the opened book is further moved so that the first line is moved away from the printing position, to able a proper adjustment of the gap with respect to the trailing half of the opened book, and the opened book is then moved back so that the first line thereof is positioned at the printing position after the gap has been properly adjusted.

According to the present invention, the detection means includes a rod-like element movable between a first position at which the rod-like element is abutted against the half side of the opened book positioned at the printing position and a second position at which the rod-like element is spaced apart from therefrom, and a sensor attached to the platen and associated with the rod-like element so that the abutting of the platen against the half side of the opened book is detected by the sensor. Preferably, the rod-like element is elastically biased toward the second position, and is forcibly moved to the first position by an suitable actuator associated therewith.

According to the present invention, the platen is engaged with an eccentric cam, which is driven in two rotational directions so that the platen is moved toward and away from the printing head. Also, the feeder means comprises at least two pair of feed rollers disposed at opposite sides of the printing position and driven by a common drive source in synchronism with each other.

BRIEF DESCRIPTION OF THE DRAWINGS

The objects and advantages of the present invention will be better understood from the following description, with reference to the accompanying drawings, in which:

FIG. 4(*b*) is a plane view of the bankbook shown in FIG. 4(*a*);

FIG. 5(*b*) is a partially enlarged view of FIG. 1, explaining a conventional adjustment of the gap between the printing head and the platen.

DESCRIPTION OF THE PREFERRED EMBODIMENTS

Figure 1:
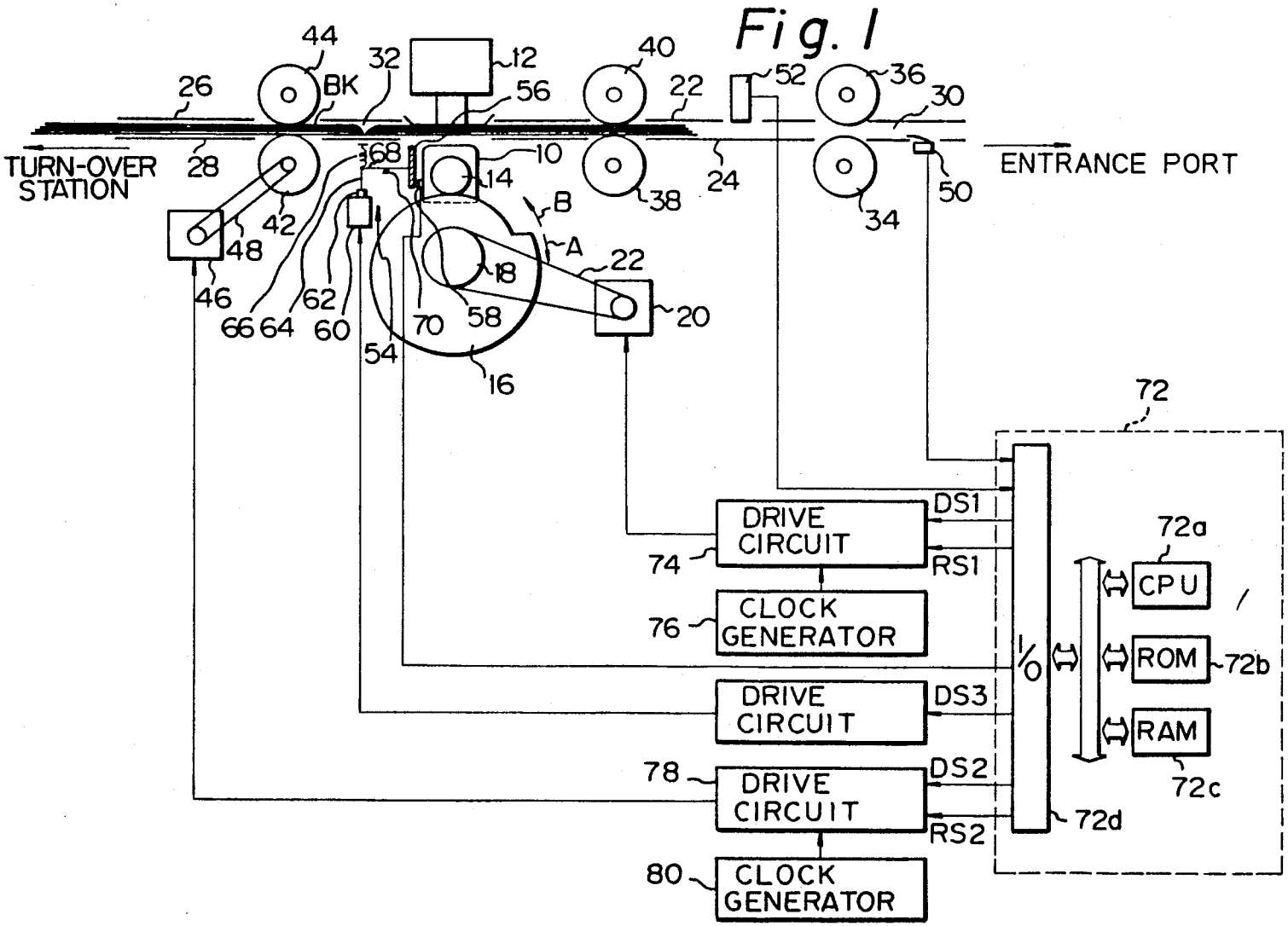
FIG. 1 is a schematic block diagram of a printer which embodies the present invention.

FIG. 1 is a schematic diagram of a printer which able to be incorporated into an automatic teller machine (ATM), a cash dispenser (CD) or the like. This printer comprises a platen 10 movably supported by a frame (not shown) of the printer, and a printing head 12 mounted on a carriage (not shown) which is moved along the platen 10 during a printing operation. The platen 10 is movable toward and away from the printing head 12, but is elastically biased by a spring (not shown) to be moved away from the printing head 12. As shown in FIG. 1, the platen 10 has a cam follower 14 secured to one end thereof and engaged with an eccentric cam 16 which can be rotated in two directions, as indicated by arrows A and B. A shaft 18 of the eccentric cam 16 is operationally connected to an output shaft of a stepping motor or pulse motor 20 through an endless drive belt 22 entrained therebetween. With this arrangement, when the eccentric cam 16 is rotationally driven by the motor 20 in the direction indicated by the arrow A, the platen is moved toward the printing head 12. On the other hand, when the eccentric cam 16 is reversely rotated by the motor 20 in the other direction, indicated by the arrow B, the platen 10 is moved away from the printing head 12.

A first pair of upper and lower guide plate members 22 and 24 and a second pair of upper and lower guide plate members 26 and 28 are provided at opposite sides of the platen 10, to thereby define first and second guide paths 30 and 32 for a center-folding type bankbook, respectively. As apparent from FIG. 1, the first guide path 30 is extended to an entrance port (not shown), for the bankbook BK provided in an ATM or CD, and the second guide path 32 is extended to a turn-over station (not shown) in which a leaf of the bankbook is turned over, if necessary.

As shown in FIG. 1, two pairs of feed rollers 34 and 36, and 38 and 40 are incorporated in the first pair of upper and lower guide plate members 22 and 24, to move the bankbook BK along the guide path 30, and a pair of feed rollers 42 and 44 is incorporated in the second pair of upper and lower guide plate members 26 and 28 to move the bankbook BK along the guide path 32. As shown in FIG. 1, the feed roller 42 is driven by a stepping or pulse motor 46 through a endless drive belt 48, and is operationally connected to the feed rollers 38 and 34 through a transmission system (not shown) so that the feed rollers 38 and 34 are driven in synchronism with the feed roller 42.

A contact switch 50 is incorporated in the lower guide plate member 24 at a location between the feed rollers 34, 36 and the entrance port, and is made ON when the bankbook BK is introduced in the open state from the entrance port into the guide path 30. Also, an optical reader 52 is incorporated in the upper guide plate member 22 at a location between the feed rollers 34, 36 and the feed rollers 38, 40, and reads a mark printed on the bankbook BK and indicating a line on which information has been printed. Namely, whenever a printing operation is carried out on a line of the opened bankbook, the mark is printed at a suitable location indicating that line, and thus it is possible to determine whether or not information has been printed on each of the lines of the opened bankbook by the optical reader 52.

When one half side of the opened bankbook BK is positioned at the printing position, a gap between the platen 10 and the printing head 12 is adjusted in response to a thickness of the half side of the bankbook, before carrying out the printing operation. The adjustment is carried out by moving the platen 10 toward the printing head 12 until the platen 10 is abutted against the half side of the bankbook BK, and then moving the platen 10 back by a given distance so that a constant gap is obtained between the printing head 12 and the half side of the bankbook BK regardless of any variation of the thickness of the half side of the opened book BK, whereby a constant optimum printing pressure is ensured.

To make this adjustment, it is necessary to stop the movement of the platen 10 toward the printing head 12 when the platen 10 abuts against the half side of the opened bankbook BK, and accordingly, the printer is provided with a detection system 54 for detecting whether or not the platen 10 is abutted against the half side of the bankbook BK. The detection system 54 includes a movable rod-like element 56 which is associated with a photo-sensor 58 attached to the platen 10. Prior to the adjustment of the gap between the platen 10 and the printing head 12, the rod-like element is moved upward from a position shown in FIG. 1, and abuts against the half side of the opened bankbook BK. Then, the platen 10 is moved toward the printing head 12 and is stopped when the bottom end of the rod-like element 56 is detected by the photo-sensor 58, so that the platen 10 abuts against the half side of the bankbook BK. Namely, the photo-sensor 58 is positioned such that the top end of the rod-like element 56 is flush with the top surface of the platen 10 when the bottom end of the rod-like element 56 is detected by the photo-sensor 58.

The detection system 54 also includes a solenoid actuator 60 for moving the rod-like element 56 upward and downward. The solenoid actuator 60 has a plunger 62 which is extended by a bar element 64 joined to the free end thereof, and which is elastically biased upward by a coil spring 66, as shown in FIG. 1. A link lever 68 is provided between the rod-like element 56 and the bar element 64, and the ends of link lever 68 are pivotally connected to the rod-like element 56 and the bar element 64, respectively. Also, the link lever 68 is pivotally fixed at a fulcrum 68 positioned at a center point thereof. With this arrangement, when the solenoid actuator 60 is electrically deenergized, the rod-like element 56 is at the lower position shown in FIG. 1, but when the solenoid actuator 60 is electrically energized, the plunger 62 is retracted against an elastic force of the coil spring 66 so that the rod-like element 56 is moved upward to be abutted against the half side of the bankbook.

The printer is controlled by a control circuit 72, which may be constructed by a microcomputer including a central processing unit (CPU) 72*a*, a read-only memory (ROM) 72*b* for storing routines, constants, etc., a random access memory (RAM) 72*c* for storing temporary data, and an input/output interface (I/O) 72*d*, as shown in FIG. 1. The contact switch 50 is connected to the I/O 72*d* and outputs a signal therethrough the control circuit 72 when a bankbook BK is introduced from the entrance port into the guide path 30. The optical reader 52 is also connected to the I/O 72*d* so that the data from the mark is fetched by the control circuit 72. Furthermore, the photo-sensor 58 is connected to the I/O 72*d* and outputs a signal therethrough to the control circuit 72 when the platen 10 is abutted against the half side of the bankbook BK.

The stepping motor or pulse motor 20 is connected to a drive circuit 74, from which drive pulses are output to the motor 20 on the basis of a clock generator 76 so that the motor 20 is driven, and the drive circuit 74 is controlled by the control circuit 72 through the I/O 72*d*. In particular, when an indication signal DS1 output from the I/O 72*d* to the drive circuit 74 is changed from a low level to a high level, the output of the drive pulses from the drive circuit 74 to the motor 20 is started, and accordingly, the eccentric cam 16 is rotated in the direction indicated by the arrow A, and when the indication signal DS1 is changed from the high level to the low level, the output of the drive pulses is ended and the rotation of the eccentric cam 16 is stopped. Also, when the indication signal DS1 is changed from the low level to the high level, and when an indication signal RS1 output from the I/O 72*d* to the drive circuit 74 is changed from a low level to a high level, the motor 20 is reversely driven so that the eccentric cam 16 is rotated in the direction indicated by the arrow B.

Similarly, the stepping or pulse motor 46 is connected to a drive circuit 78 from which drive pulses are output to the motor 46 on the basis of a clock generator 80 so that the motor 46 is driven, and the drive circuit 78 is controlled by the control circuit 72 through the I/O 72*d*. In particular, when an indication signal DS2 output from the I/O 72*d* to the drive circuit 78 is changed from a low level to a high level, the output of the drive pulses from the drive circuit 78 to the motor 46 is started so that the feed rollers 42, 38 and 34 are driven counterclockwise to move the bankbook BK from right to left in FIG. 1, and when the indication signal DS2 is changed from the high level to the low level, the output of the drive pulses is ended so that the motor 46 is stopped. Also, when the indication signal DS1 is changed from the low level to the high level, and when an indication signal RS2 output from the I/O 72*d* to the drive circuit 78 is changed from a low level to a high level, the motor 46 is reversely driven so that the feed rollers 42, 38 and 34 are rotated clockwise to move the bankbook BK from left to right in FIG. 1.

The operation of the above-mentioned printer will be now explained with reference to FIGS. 2 and 3, which show a main routine for the control of the printing operation and a sub-routine used therein for the control of the adjustment of the gap between the platen and the printing head 12. Note, as shown in FIGS. 4(*a*) and 4(*b*), both of the half sides of the opened bankbook BK contain twenty-two lines $L_N$ (N=1, 2, . . . 24) on which information can be printed.

Figures 2, 2A:
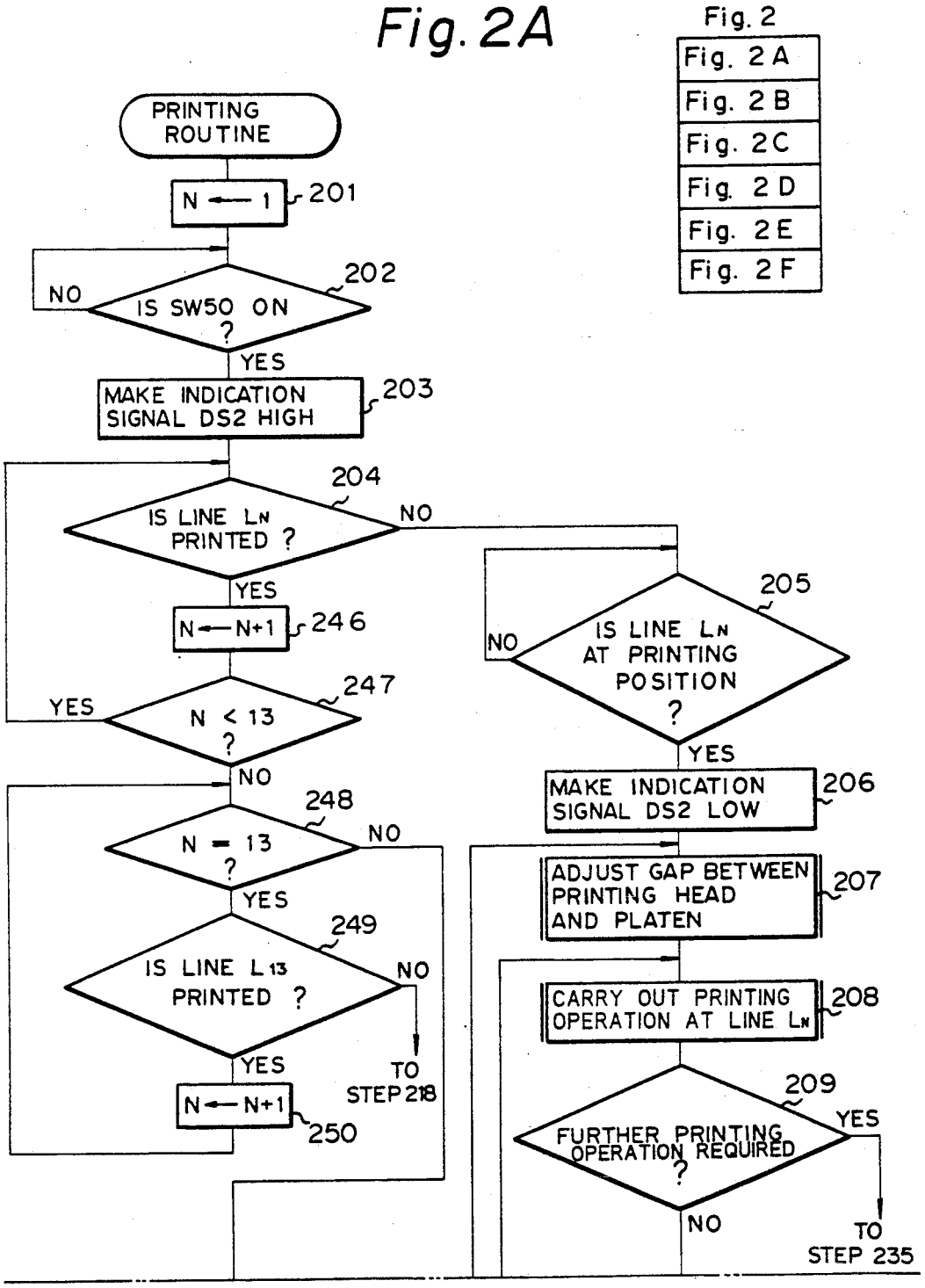
FIG. 2 is a main flow chart explaining an operation of the printer shown in FIG. 1, with FIGS. 2A–2F being detailed sub-charts of FIG. 2.
Figure 2B:
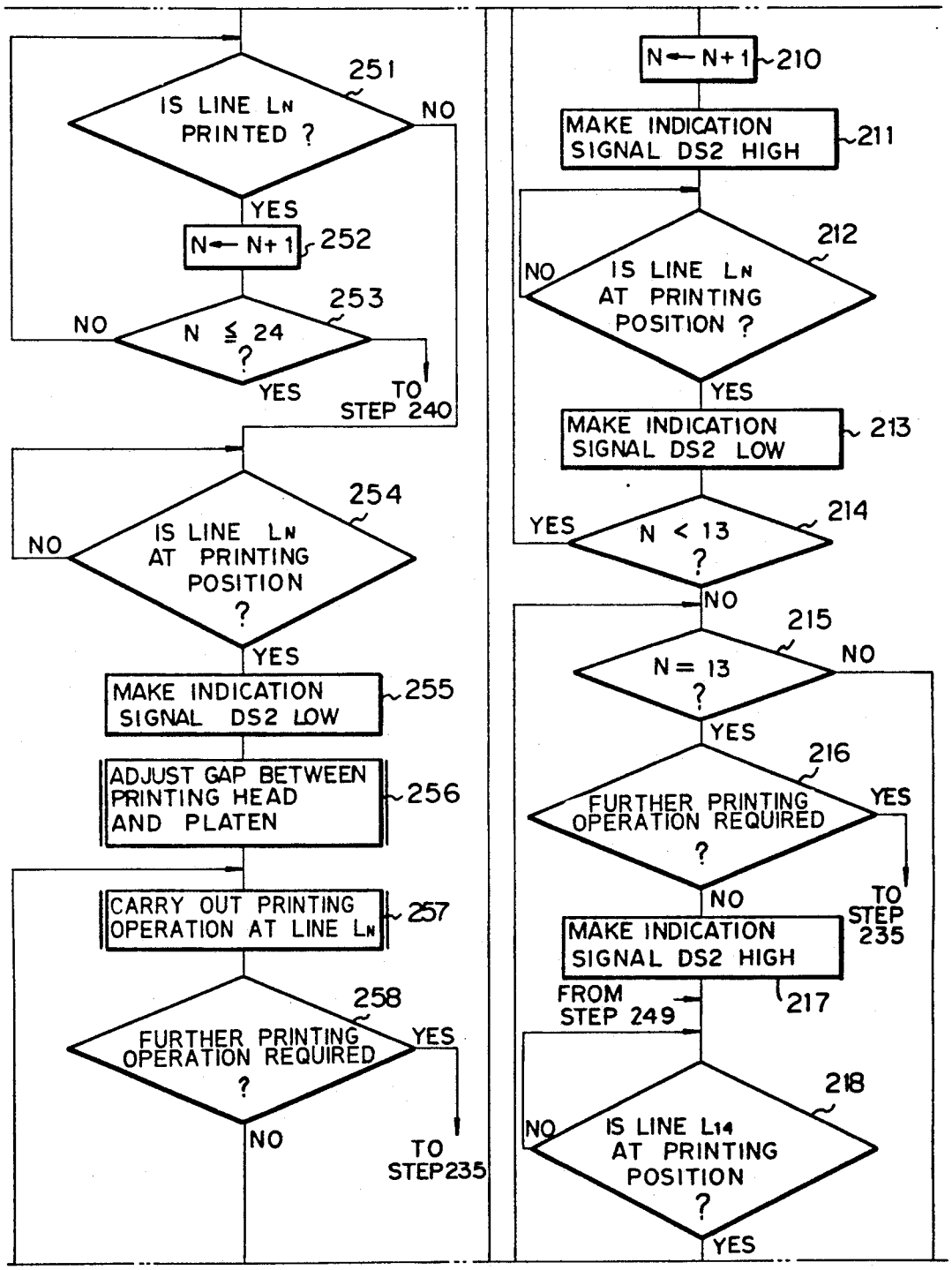
Figure 2C:
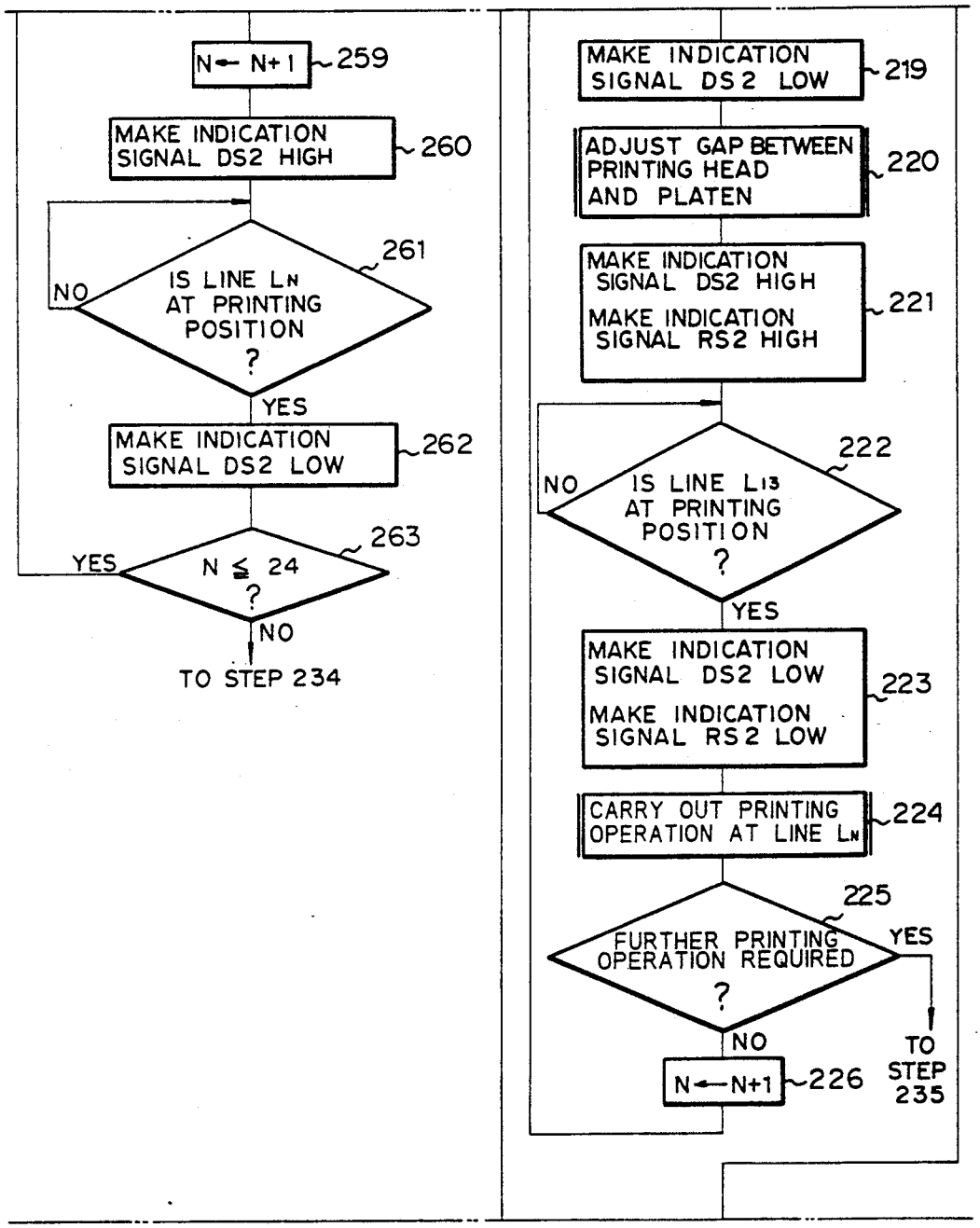
Figure 2D:
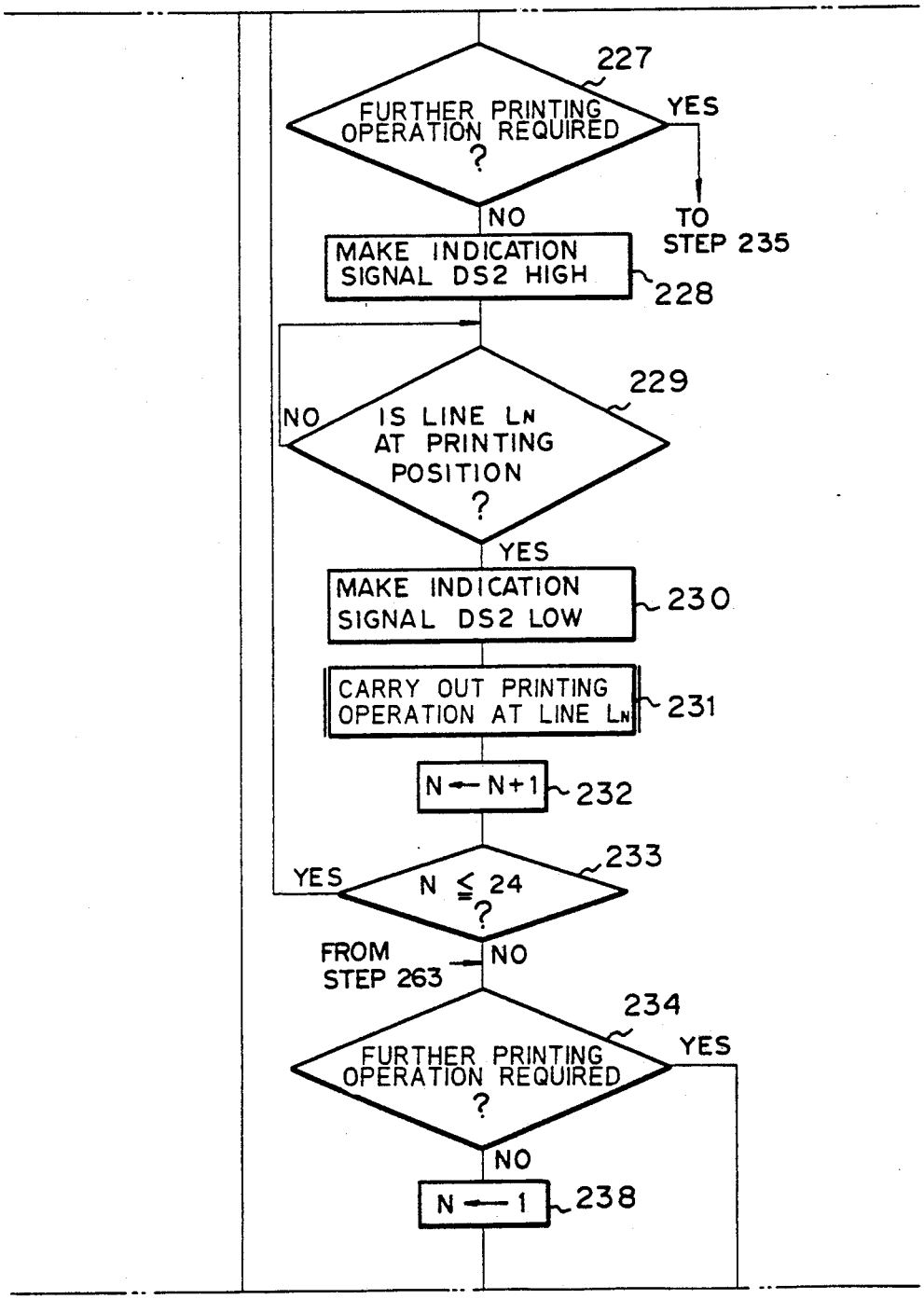
Figure 2E:
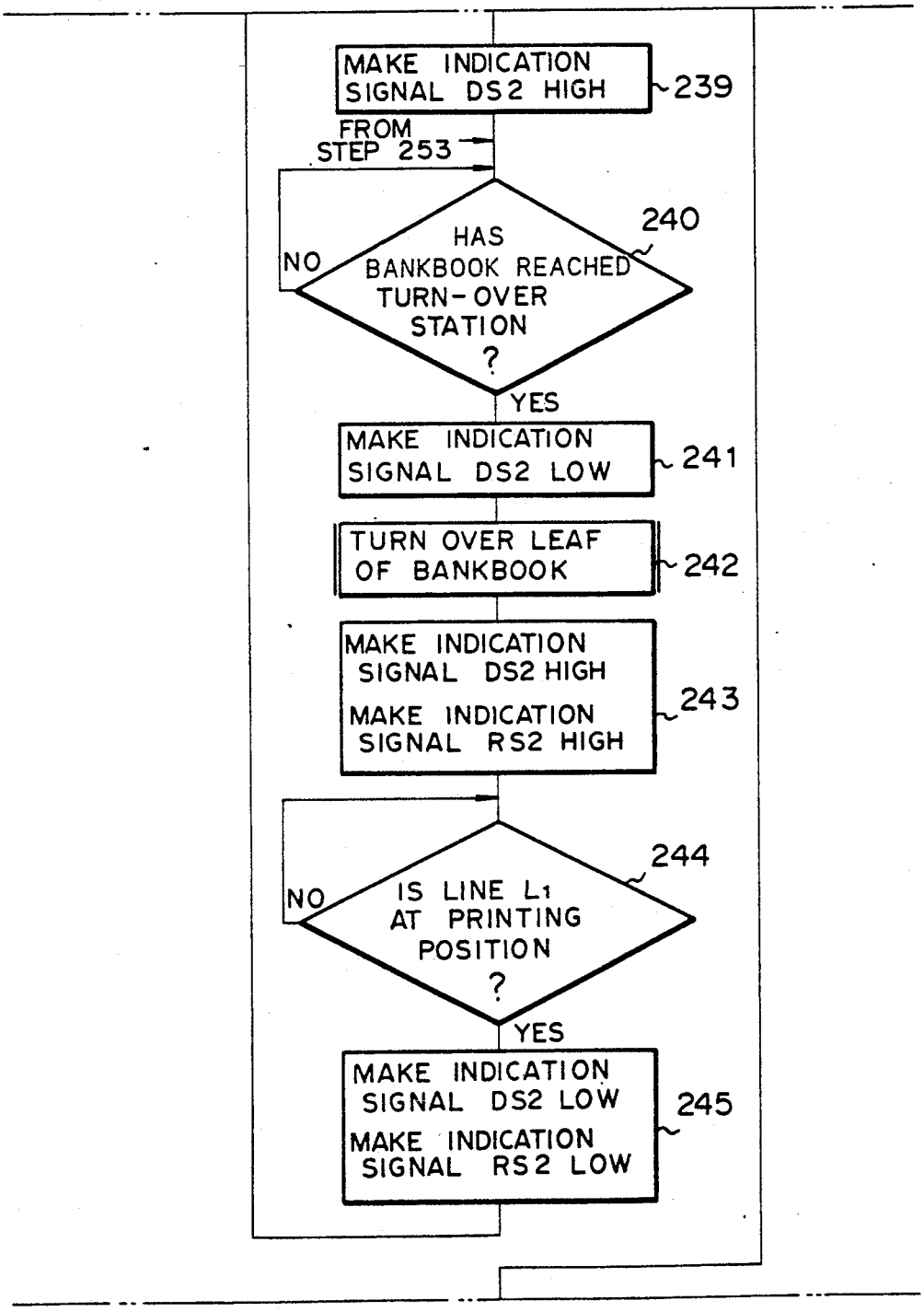
Figure 2F:
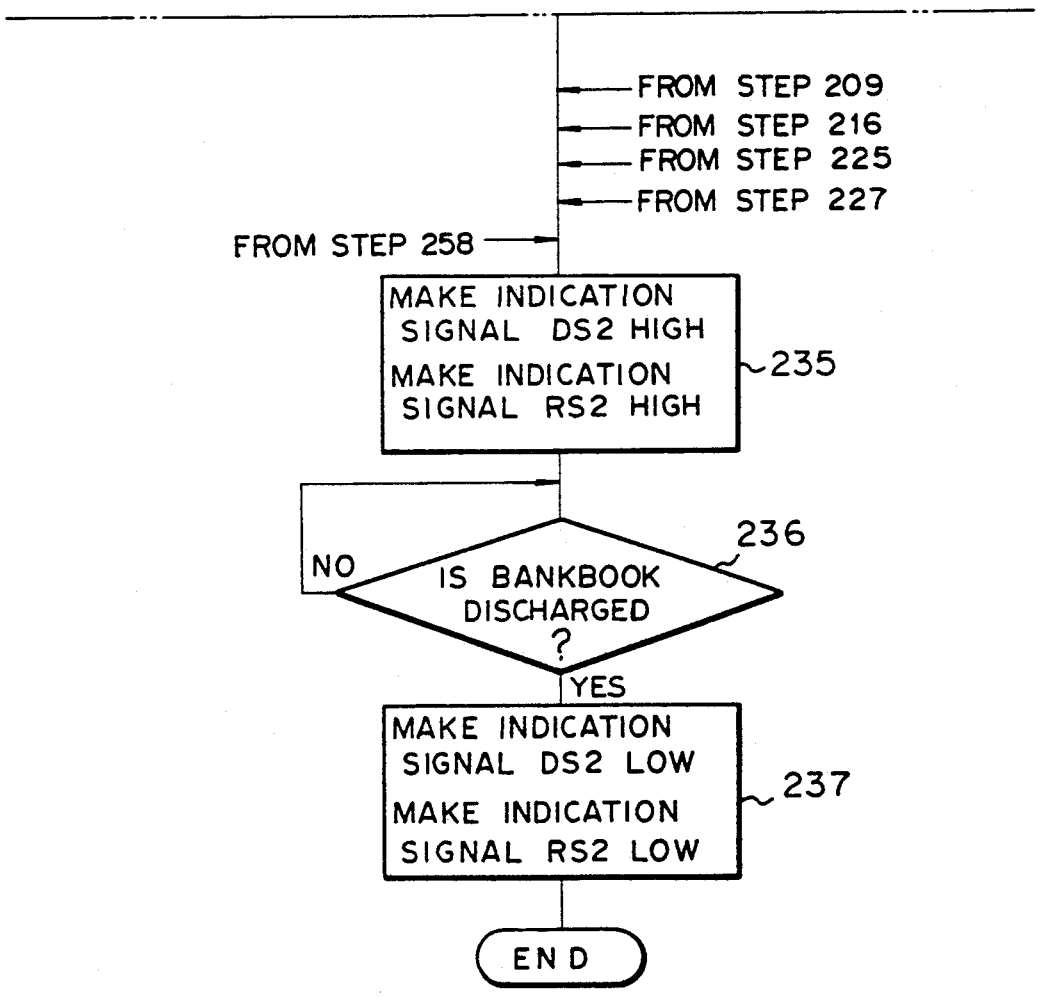

At step 201 of the main routine of FIG. 2, a counter N is reset to "1". Then, at step 202, it is determined whether or not the contact switch 50 is made ON. If the switch 50 is made ON by the introduction of the bankbook BK from the entrance port into the guide path 30, in the open state, the control proceeds to step 303, in which the indication signal DS2 is changed from the low level to the high level, and thus the motor 46 is driven to rotate the feed rollers 42, 38 and 34 in the counterclockwise direction (FIG. 1), whereby the bankbook BK is moved toward a reading position defined by the optical reader 52.

While the bankbook BK is passed through the reading position, the mark data is read by the optical reader 52 and is then fetched by the control circuit 72. Then, at step 204, it is determined, on the basis of the mark data whether or not a printing operation has been carried out on the first line $L_1$. If the printing operation has not been carried out on the first line $L_1$, the control proceeds to step 205 in which it is determined whether the first line $L_1$ has reached the printing position defined by the platen 10 and the printing head 12. If the first line $L_1$ has reached the printing position, the control proceeds to step 206 in which the indication signal DS2 is changed from the high level to the low level, whereby the motor 46 is deenergized, and thus the movement of the bankbook BK is stopped so that the line $L_1$ can be positioned at the printing position.

Figure 3:
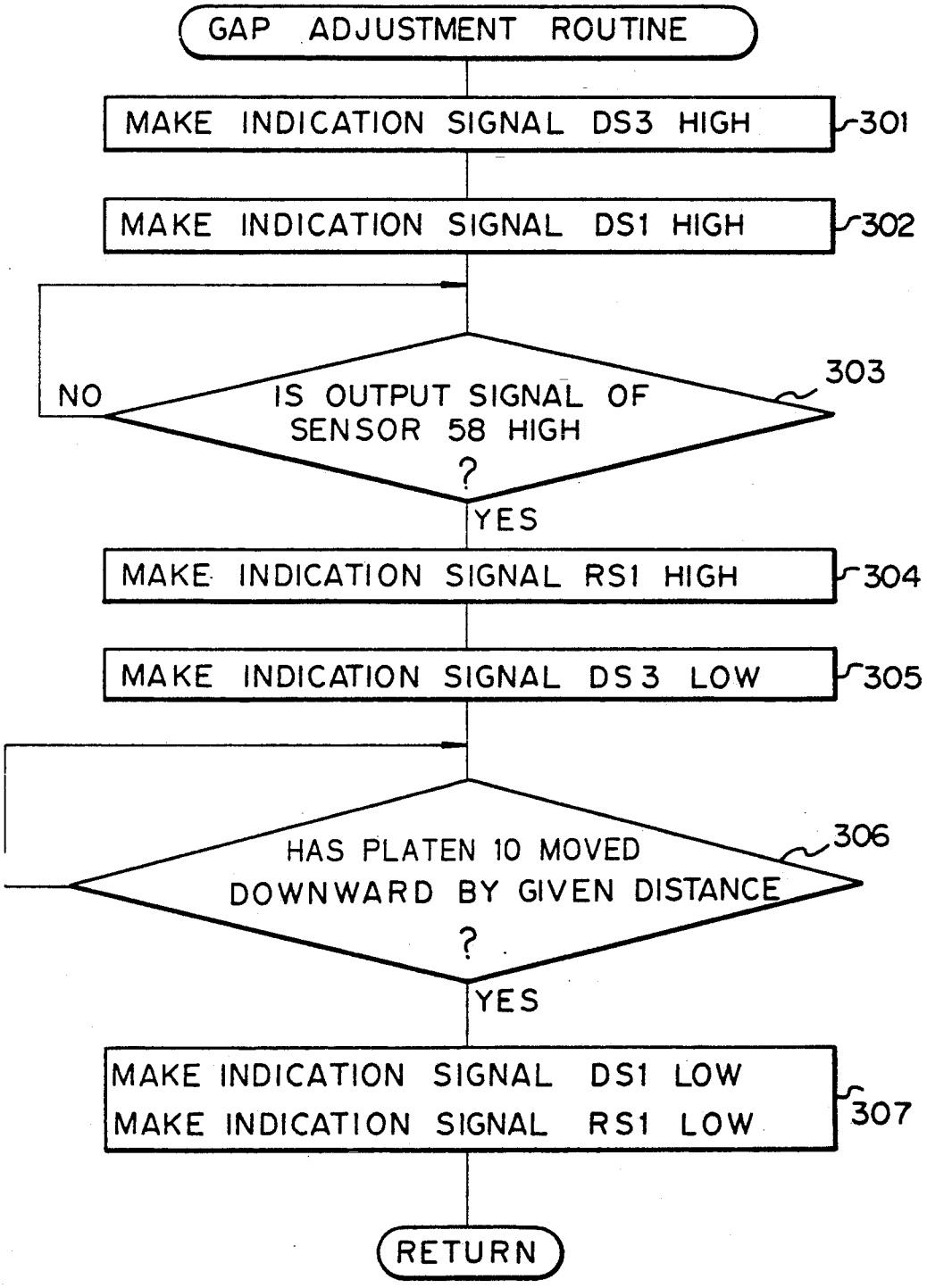
FIG. 3 is a sub-flow chart used in the main routine for an adjustment of a gap between a printing head and a platen included in the printer of FIG. 1.
Figure 4A:
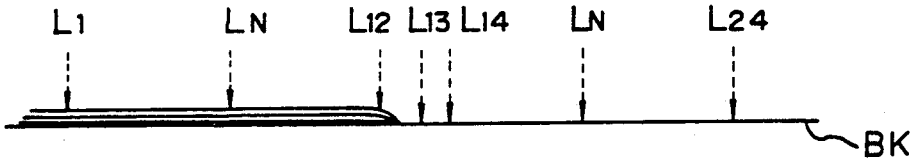
FIG. 4(*a*) is an side view of a bankbook in the open state, in which information is printed by the printer of FIG. 1.
Figure 4B:
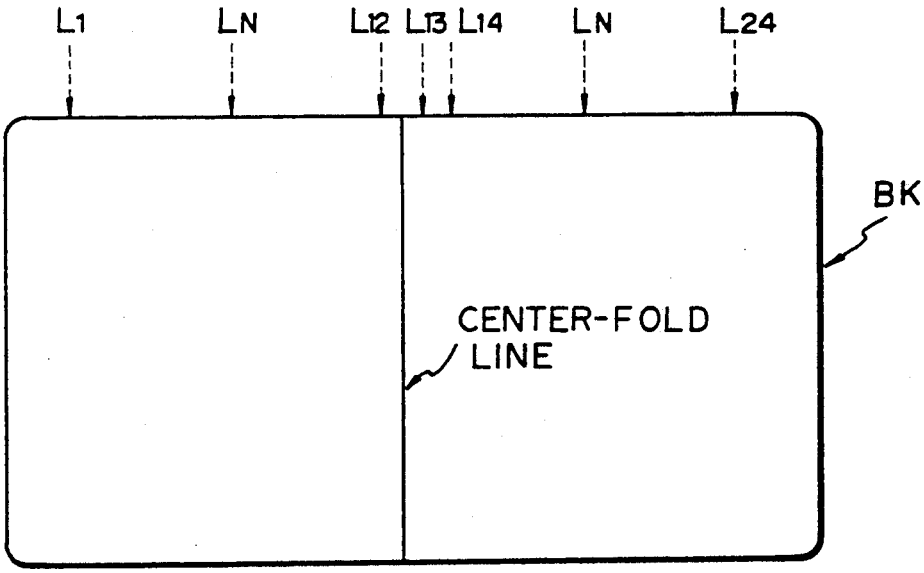

At step 207, the sub-routine of FIG. 3 is executed so that the gap between the platen 10 and the printing head 12 is adjusted in response to a thickness of the leading half side of the bankbook BK, which contains the first line $L_1$. At step 208, a suitable sub-routine (not shown) for the control of the printing operation is executed so that a printing operation is carried out on the first line $L_1$. Then, at step 209, it is determined whether or not a further printing operation should be carried out on the next line $L_2$. When a further printing operation is to be carried out on the next line $L_2$, the control proceeds to step 210 in which the counter N is incremented by "1". Then, at step 211, the indication signal DS2 is made high, and thus the bankbook BK is moved. At step 212, it is determined whether or not the line $L_2$ has reached the printing position. If the line $L_2$ has reached the printing position, the control proceeds to step 213 in which the indication signal DS2 is made low, and thus the bankbook BK is stopped so that the line $L_2$ can be positioned at the printing position. Then, at step 214, it is determined whether or not the counter number of the counter N is less than "13". In this case, since $N<13$, the control returns to step 208 in which the printing operation is carried out on the line $L_2$.

When the printing operations are carried out on the lines $L_3$ to $L_{12}$, the counter number of the counter N is counted up by "13" at step 310, so that the control proceeds from step 214 to step 215 in which it is determined whether or not the count number of the counter N is equal to "13". In this case, since N=13, the control proceeds to step 216 in which it is determined whether or not a further printing operation should be carried out on the line $L_{13}$. When the printing is carried out on the line $L_{13}$, the control proceeds to step 217 in which the indication signal DS2 is made high, and thus the bankbook BK is moved. At step 218, it is determined whether or not the line $L_{14}$ has reached the printing position. If the line $L_{14}$ has reached the printing position, the control proceeds to step 219 in which the indication signal DS2 is made low, and thus the bankbook BK is stopped so that the line $L_{14}$ can be positioned at the printing position. Then, at step 220, the sub-routine of FIG. 3 is executed so that the gap between the platen 10 and the printing head 12 is adjusted in response to a thickness of the trailing half side of the bankbook BK, which contains the first line $L_{14}$ thereof.

At step 221, the indication signals DS2 and RS2 are made high so that the motor 46 is reversely driven, and thus the bankbook BK is moved back. Then, at step 222, it is determined whether or not the line $L_{13}$ has reached the printing position. If the line $L_{13}$ has reached the printing position, the control proceeds to step 223 in which the indication signals DS2 and RS2 are made low, and thus the bankbook BK is stopped so that the line $L_{13}$ can be positioned at the printing position. At step 224, the sub-routine for the control of the printing operation is executed so that the printing operation is carried out on the first line $L_{13}$, and then at step 225, it is determined whether or not a further printing should be carried out on the line $L_{14}$. When a further printing operation is to be carried out on on the line $L_{14}$, the control proceeds to step 226 in which the counter N is incremented by "1", and then the control returns to step 215 in which it is determined whether or not the count number of the counter N is equal to "13". In this case, since N (=14) is not equal to "13", the control proceeds to step 227.

At step 227, it is determined whether or not a further printing operation should be carried out on the line L–. When the printing operation is carried out on the line $L_{14}$, the control proceeds to step 228 in which the indication signal DS2 is made high so that the motor 46 is driven, and thus the bankbook BK is moved. At step 229, it is determined whether or not the line $L_{14}$ has reached the printing position. If the line $L_{14}$ has reached the printing position, the control proceeds to step 230 in which the indication signal DS2 is made low, and thus the bankbook BK is stopped so that the line $L_{14}$ can be positioned at the printing position. At step 231, the printing operation is carried out the line $L_{14}$ in accordance with the sub-routine for the control of the printing operation, and at step 232, the counter N is incremented by "1". Then, at step 233, it is determined whether or not the count number of the counter N is less than "24". In this case, since N=15<24, the control returns to step 227.

When the printing operations are carried out on the lines $L_{15}$ to $L_{24}$, the counter N is counted up by "24", and thus the control proceeds from step 233 to step 234 in which it is determined whether or not further printing operations should be carried out. When no further printing operations are to be carried out, the control proceeds to step 235 in which the indication signals DS2 and RS2 are made high so that the motor 46 is reversely driven, and thus the bankbook BK is moved back. Then, at step 236, it is determined whether or not the bankbook BK has been discharged from the entrance port. When the bankbook BK has been discharged from the entrance port, the indication signals DS2 and RS2 are made low so that the motor 46 is stopped, and thus this routine is completed.

Note, at each of steps 209, 216, 225 and 227, when no further printing operations are carried out, the control jumps to step 235, and thus the bankbook BK is discharged from the entrance port.

At step 234, if further printing operations are to be carried out, the control proceeds to step 238 in which the counter N is reset to "1". Then, at step 239, the indication signal DS2 is made high so that the motor 46 is driven to move bankbook BK toward the turn-over station (not shown in FIG. 1), and at step 240, it is determined whether or not the bankbook BK has reached the turn-over station. If the bankbook BK has reached the turn-over station, the control proceeds to step 241 in which the indication signal DS2 is made low so that the motor 46 is stopped. Then, at step 242, a leaf of the bankbook BK is turned over in accordance with a suitable sub-routine (not shown) for the control of a leaf turn-over operation. Then, at step 243, the indication signals DS2 and RS2 are made high so that the motor 46 is reversely driven, and thus the bankbook BK is moved back, and at step 244, it is determined whether or not a fresh first line $L_1$ of the bankbook BK has reached the printing position. If the fresh line $L_1$ has reached the printing position, the control proceeds to step 245 in which the indication signals DS2 and RS2 are made low so that the motor 46 is stopped, and then the control returns to step 207.

At step 204, if the printing operation has been carried out on the first line $L_1$, the control proceeds to step 246 in which the counter N is incremented by "1", and then at step 247, it is determined whether or not the count number of the counter N is less than "13". In this case, since N=2<13, the control returns to step 204. For example, when printing operations have been carried out on the lines $L_1$ to $L_5$, so that the counter N is counted up by "6" at step 246, the control proceeds from step 204 to step 205.

When the printing operations have been carried out on the lines $L_2$ to $L_{12}$, the count number of the counter N is counted up by "13", and then the control proceeds to step 248, in which it is determined whether or not the counter number of the counter N is equal to "13". In this case, since N=13, the control proceeds to step 249 in which it is determined whether or not the printing operation has been carried out on the line $L_{13}$. If the printing operation has not been carried out on the line $L_{13}$, the control jumps from step 249 to step 218.

On the other hand, If the printing operation has been made on the line $L_{13}$, the control proceeds to step 250 in which the count number of the counter N is incremented by "1", and then the control returns to step 248. In this case, since N=14, the control proceeds from step 248 to step 251 in which it is determined whether or not the printing operation has been carried out on the line $L_{14}$. If the printing operation has been carried out on the line $L_{14}$, the control proceeds to step 252 in which the count number of the counter N is incremented by "1", and then the control proceeds to step 253 in which it is determined whether or not the count number of the counter N exceeds "24". In this case, since N=15<24, the control returns to step 251. When the printing operations have been carried out on the lines $L_1$ to $L_{24}$ (this means that the bankbook BK has been introduced into the guide path 30 when incorrectly opened), the control proceeds to step 240.

For example, when the printing operations have been carried out on the lines $L_1$ to $L_{18}$ so that the counter N is counted up by "19" at step 252, the control proceeds from step 251 to step 254 in which it is determined whether or not the line $L_{19}$ has reached the printing position. If the line $L_{19}$ has reached the printing position, the control proceeds to step 255 in which the indication signal DS2 is made low, and thus the bankbook BK is stopped so that the line $L_{19}$ can be positioned at the printing position. Then, at step 256, the sub-routine of FIG. 3 is executed so that the gap between the platen 10 and the printing head 12 is adjusted in response to a thickness of the trailing half side of the bankbook BK.

At step 257, the printing operation is carried out on the first line $L_{19}$ in accordance with the subroutine for the control of the printing operation, and then at step 258, it is determined whether or not a further printing operation should be carried out. If no further printing operations are required, the control proceeds from step 258 to step 235.

On the other hand, when further printing operations are required, the control proceeds to step 259 in which the counter N is incremented by "1". Then at step 260, the indication signal DS2 is made high so that the motor 46 is driven, and thus the bankbook BK is further moved. At step 261, it is determined whether or not the next line $L_{20}$ has reached the printing position. If the line $L_{20}$ has reached the printing position, the control proceeds to step 262 in which the indication signal DS2 is made low, and thus the bankbook BK is stopped so that the line $L_{20}$ can be positioned at the printing position. Then, at step 263, it is determined whether or not the counter number of the counter N exceeds "24". In this case, since $N=20<24$, the control returns to step 235 in which the printing operation is carried out on the line $L_{20}$. When the printing operations are carried out on the lines $L_{21}$ to $L_{24}$, so that the counter N is counted up by "25", the control proceeds from step 263 to step 234.

The sub-routine of FIG. 3 for the control of the adjustment of the gap between the platen 10 and the printing head 12 is executed as follows:

At step 301, the indication signal DS3 is changed from a low level to a high level so that the solenoid actuator 60 is electrically energized to retract the plunger 62 against the elastic force of the spring 66, whereby the rod-like element is moved upward and abutted against the half side of the bankbook BK. Then, at step 302, the indication signal DS1 is also changed from a low level to a high level so that the stepping or pulse motor 20 is driven to rotate the eccentric cam 16 in the direction indicated by the arrow A, and thus the platen 10 is moved toward the printing head 12.

At step 303, it is determined whether or not a signal output from the sensor 58 is changed from a low level to a high level. This level change means that the bottom end of the rod-like element 56 has been detected by the sensor 58. As mentioned above, the platen 10 is abutted against the half side of the bankbook BK when the bottom end of the rod-like element 56 is detected by the sensor 58. At step 304, the indication signal RS1 is changed from a low level to a high level so that the motor 20 is reversely driven to rotate the eccentric cam 16 in the direction indicated by the arrow B, whereby the platen is moved away from the printing head 12.

At step 305, the indication signal DS3 is made low so that the solenoid actuator is electrically deenergized, whereby the plunger 62 is lifted up by the spring 66 so that the rod-like element 56 is lowered, as shown in FIG. 1.

Then, the control proceeds to step 306 in which it is determined whether or not the platen 10 has moved downward by a given distance. When the downward movement of the platen 10 by the given distance has been carried out, the control proceeds to step 307 in which the indication signals SD1 and RS1 are made low so that a constant gap can be obtained between the printing head 12 and the half side of the book BK regardless of a variation of thickness thereof, whereby a constant optimum printing pressure can be ensured.

Figure 5A:
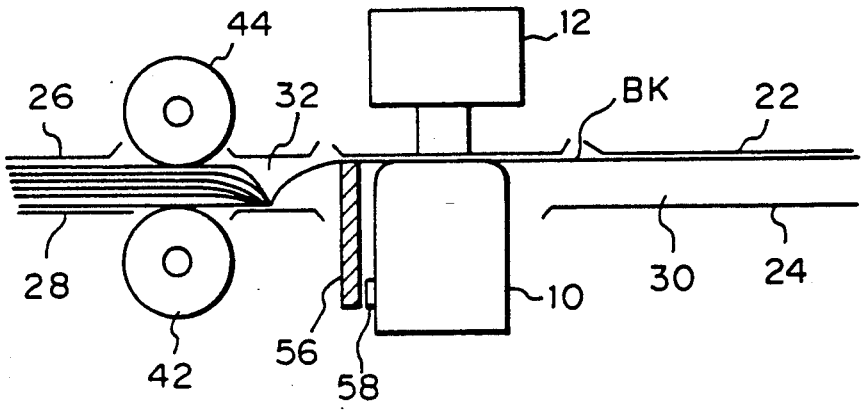
FIG. 5(*a*) is a partially enlarged view of FIG. 1, explaining the adjustment of the gap between the printing head and the platen in accordance with the present invention.
Figure 5B:
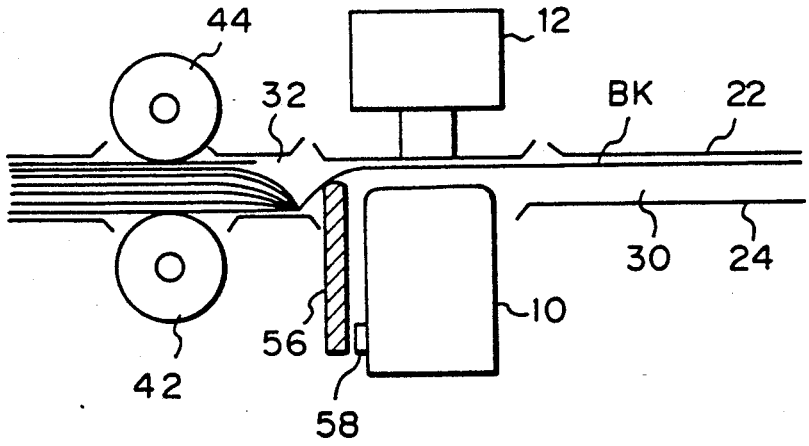

FIG. 5(*a*) illustrates the adjustment of the gap between the platen 10 and the printing head 12, which is carried out at step 220 of the routine of FIG. 2. In this case, the line $L_{14}$ of the bankbook BK is positioned at the printing position so that the rod-like element is properly abutted against the trailing half side of the bankbook BK, whereby an optimum gap can be obtained between the platen 10 and the printing head 12. Conversely, FIG. 5(*b*) illustrates the conventional adjustment of the gap between the platen 10 and the printing head 12. In this case, the line $L_{13}$ of the bankbook BK is positioned at the printing position, and therefore, the rod-like element is improperly abutted against the trailing half side of the bankbook BK because a portion of the trailing half side of the bankbook BK, which is close to the center-holding line thereof does not represent a proper thickness of the trailing half side, because the portion concerned is curved due to the binding of the leaves of the bankbook, as easily understood from FIG. 5(*b*).

As shown above, according to the present invention, when the printing operation is to be transferred from one half side of an opened book to the other half side thereof, and when the line closest to the center-holding line and contained in the other half side of the opened book is positioned at the printing position, the adjustment of the gap between the platen and the printing head is avoided, whereby a proper adjustment of the gap can be always ensured.

Finally, it will be understood by those skilled in the art that the foregoing description is of a preferred embodiment of the present invention, and that various changes and modifications thereof can be made without departing from the spirit and scope thereof.

I claim:

1. A printer for printing information on a center-folding type book when the book is in the open state, which comprises:

a printing head;

a platen movable toward and away from said printing head;

feeder means for moving the opened book through a printing position defined by said printing head and said platen, in such a manner that the printing operation is carried out on a leading half side of the opened book and then carried out on a trailing half side thereof; and adjustment means for adjusting a gap between said printing head and said platen in response to a variation of a thickness of the half side of the opened book positioned at said printing position, said adjustment means including detection means for detecting an abutting of said platen against the half side of the opened book during a movement of said platen toward said printing head, and means for moving said platen away from said printing head by a given distance after the abutting of said platen against the half side of the opened book, whereby a constant optimum gap is obtained between said printing head and said platen regardless of variations of a thickness of the half side of the opened book, wherein before the printing operation is carried out, said opened book is further moved by said feeder means so that a first line of information contained in the trailing half of the opened book and closest to a center-holding line thereof and is moved away from said printing position, to carry out a proper adjustment of the gap with respect to the trailing half of the opened book by said adjustment means, the opened book then being moved back by said feeder means so that said first line is positioned at said printing portion after the gap has been properly adjusted.

2. A printer as set forth in claim 1, wherein said detection means includes a rod-like element movable between a first position at which said rod-like element is abutted against the half side of the opened book positioned at said printing position and a second position at which said rod-like element is spaced apart from therefrom, and a sensor attached to said platen and associated with said rod-like element so that the abutting of said platen against the half side of the opened book is detected by said sensor.

3. A printer as set forth in claim 2, wherein said rod-like element is elastically biased toward said second position, and is forcibly moved to said first position by a suitable actuator associated therewith.

4. A printer as set forth in claim 3, wherein said actuator comprises a solenoid actuator.

5. A printer as set forth in claim 1, wherein said platen is engaged with an eccentric cam which is driven in two rotational directions so that said platen is moved toward and away from said printing head.

6. A printer as set forth in claim 1, wherein said feeder means comprises at least two pair of feed rollers disposed at opposite sides of said printing position and driven by a common drive source in synchronism with each other.

* * * * *